US005145111A

United States Patent [19]

Giblin

[11] Patent Number: 5,145,111

[45] Date of Patent: Sep. 8, 1992

[54] CARTON WITH INTEGRAL CLOSURE

[75] Inventor: Edward J. Giblin, Finksburg, Md.

[73] Assignee: Lever Brothers Company, Division of Conopco, Inc., New York, N.Y.

[21] Appl. No.: 459,019

[22] Filed: Dec. 29, 1989

[51] Int. Cl.[5] ..... B65D 5/70

[52] U.S. Cl. ..... 229/219; 229/217

[58] Field of Search ..... 206/621.3, 621.6, 621.7, 206/622, 626, 631.2; 229/214, 215, 217, 219, 248

[56] References Cited

U.S. PATENT DOCUMENTS

| | | | |
|---|---|---|---|
| D. 304,300 | 10/1989 | Duke | D9/433 |
| 2,010,863 | 8/1935 | Johnson | 206/621.6 |
| 2,020,680 | 11/1935 | Forrer | 206/621.7 |
| 2,819,832 | 1/1958 | Stoller et al. | 206/626 |
| 2,946,496 | 7/1960 | Stagmeier | 206/621.7 |
| 3,096,921 | 7/1963 | Graybill | 206/621.7 |
| 3,395,848 | 8/1968 | Johnson | 206/622 |
| 4,142,635 | 3/1979 | Capo et al. | 206/621.7 |
| 4,308,956 | 1/1982 | Steinke et al. | 206/621.7 |
| 4,650,078 | 3/1987 | Desmond et al. | 206/621.7 |
| 4,706,875 | 11/1987 | Blackman | 206/626 |
| 4,732,315 | 3/1988 | Gunn | 229/125.09 |
| 4,909,395 | 3/1990 | Weissman | 206/621.6 |
| 4,967,910 | 11/1990 | Schuster | 206/621.6 |

FOREIGN PATENT DOCUMENTS

| | | | |
|---|---|---|---|
| 565842 | 11/1944 | United Kingdom | 206/621.3 |
| 1203772 | 9/1970 | United Kingdom | 206/621.3 |
| 1353080 | 5/1974 | United Kingdom | 206/621.3 |

*Primary Examiner*—Gary E. Elkins

*Attorney, Agent, or Firm*—Gerard J. McGowan, Jr.

[57] ABSTRACT

A carton blank and carton wherein an outer wall includes a die cut defining a cover and an inner wall disposed parallel to the cover inside the outer wall. The inner wall includes a die cut defining a removable plug. The plug is adhered to the cover so that when the consumer grasps the cover and opens it, the plug adheres to the cover and is removed from the inner wall, thereby creating a pouring opening. The plug preferably may be re-fit snugly within the pouring aperture when the cover is closed.

20 Claims, 5 Drawing Sheets

CARTON WITH INTEGRAL CLOSURE

BACKGROUND OF THE INVENTION

Detergent cartons are typically provided with perforated lines along which the consumer is expected to make a tear to create an opening. However, consumers tend to find it difficult to tear cleanly the carton. Moreover, the opening thus created is not reclosable, so unwanted escape of product often occurs during transport of the carton from its place of storage to the washing location.

Gunn U.S. Pat. No. 4,732,315 discloses a plastic fitment which can be glued onto a carton blank and which serves as a reclosable pouring spout. However, a significant increase in the amount of plastic used for detergent cartons may be undesirable on environmental grounds. Moreover, Gunn discloses that the increased thickness attributable to the plastic fitment requires increasing the thickness of the carton blank in a location remote from the fitment in order to balance the thickness of the carton. Otherwise, when the carton blanks in folded tubular form are stacked, the stack becomes unbalanced due to the increased thickness at one location.

There is, therefore, a need for a carton closure which does not increase the amount of plastic present on the carton and which does not tend to cause an imbalance in the carton.

SUMMARY OF THE INVENTION

The invention is directed to a carton, an outer wall of which includes a die cut defining a cover at least partially detachable from the outer wall and an inner wall disposed parallel to the cover inside the outer wall. The inner wall includes a die cut defining a removable plug. The plug is adhered to the cover so that when the consumer grasps the cover and opens it, the plug adheres to the cover and is removed from the inner wall, thereby creating a pouring opening. Preferably, the cover is connected to the outer wall by a foldable score line and includes a grasping tab on the side opposite the score line. The plug preferably comprises, at least in part, sawtooth edges to enhance its ability to be refit snugly within the pouring aperture when the cover is closed. In another embodiment, there is no plug, and only an aperture in the inner wall.

Preferably, the outer wall constitutes the upper outer major flap and the inner wall constitutes the upper inner major flap. In such a case, it is preferred that the minor flap which underlies the end of the carton at which the cover is located, is cut away so that it does not interfere with flow of product through the pouring aperture. The carton may be provided with a tuck feature whereby the cover can be securely tucked into slits in the inside major flap.

The invention is also directed to a carton blank used for making the carton according to the invention.

For a more complete understanding of the above and other features and advantages of the invention, reference should be made to the following detailed description of preferred embodiments and to the accompanying drawings.

DETAILED DESCRIPTION OF THE INVENTION

Figure 1:
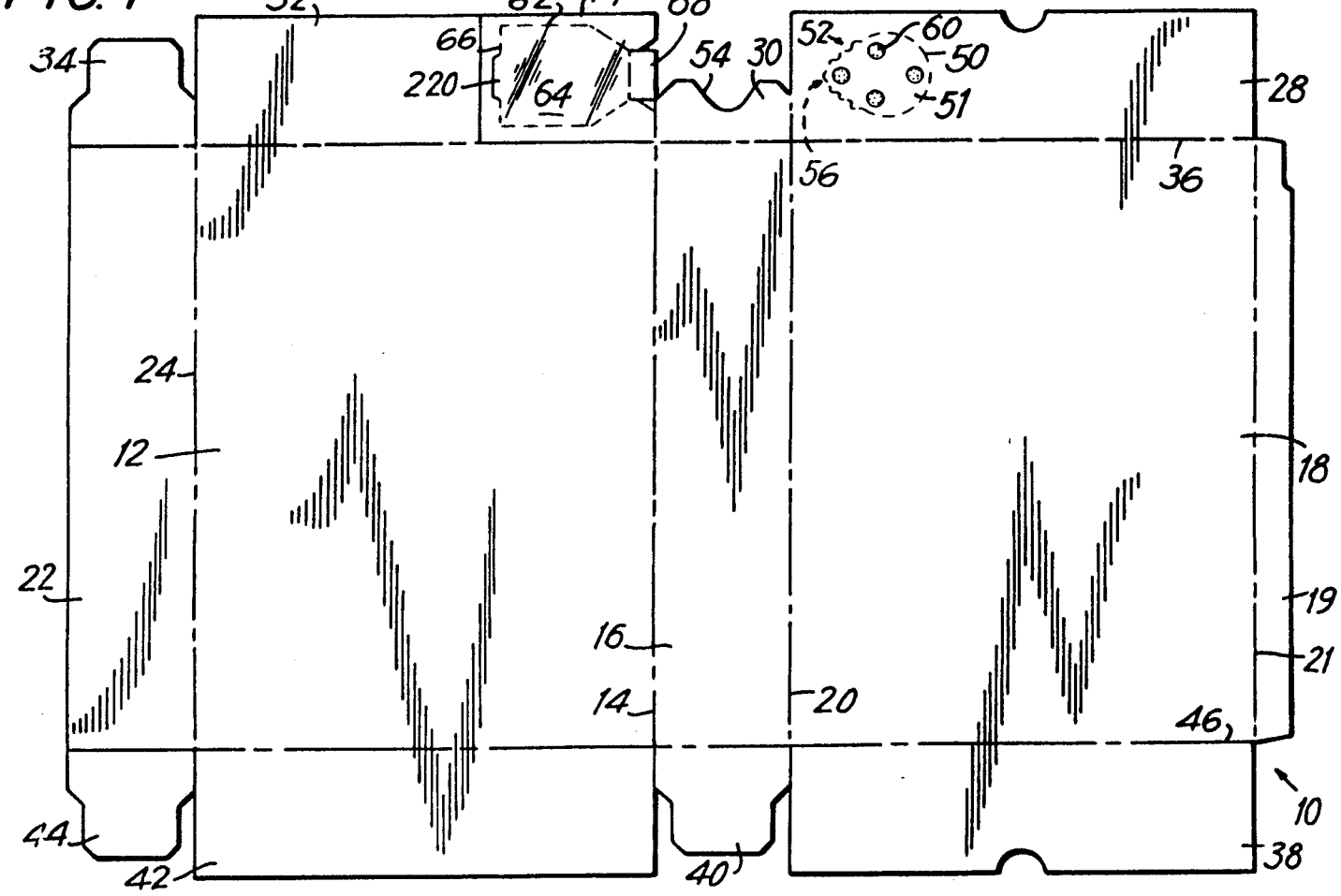
FIG. 1 is a top plan view of the outside of a carton blank according to the invention.

Referring to FIG. 1, carton blank 10 includes front panel 12 separated by score line 14 from first side panel 16. First side panel 16 is adjacent to rear panel 18 and separated therefrom by score line 20. Second side panel 22 is located adjacent front panel 12 on the side opposite the first side panel 16. Front panel 12 is separated from second side panel 22 by score line 24.

The top closure flaps include inside major panel 28, first minor flap 30 outside major panel 32 and second minor flap 34. Upper inside major panel flap 28, upper first minor flap 30, upper outside major flap 32 and upper second minor flap 34 are separated by score line 36 from rear panel 18, first side panel 16, front panel 12 and second side panel 22, respectfully. The lower closure flaps comprise inner major flap 38, first minor flap 40, outside major flap 42 and second minor flap 44. Lower inside major flap 38, lower first minor flap 40, lower inside major flap 42 and lower second minor flap 44 are separated by score line 46 from rear panel 18, first side panel 16, front panel 12 and second side panel 22, respectfully.

Upper inside major panel 28 includes die cut 50 defining a removable plug 51. Preferably the plug is in the shape of a teardrop having the narrower end facing the closer end of the carton as shown. Advantageously, the plug includes a plurality of sawtooth edges for reasons which will be discussed hereinbelow. Preferably the sawtooth edges constitute at least 5% of the circumference of the plug, preferably at least 20%, especially, 30%.

Comparison of first upper minor flap 30 with second upper minor flap 34 reveals that flap 30 has portions cut away relative to flap 34. For reasons that will become apparent, cut 54 of flap 30 matches the contour of the pouring end 56 of the plug. Plug 51 includes adhesive application areas which may be located at areas 60, and which may be debossments.

Glue flap 19 is adjacent and parallel to rear panel 18 and separated therefrom by score line 21.

Die cut 62 has been impressed upon outside major flap 32 to form a reclosable cover 64. Foldable score line 66 serves as a hinge at which cover 64 pivotally attaches to flap 32. A pull tab 68 is formed in the end of cover 64 opposite that of the hinge 66. Foot 220 keeps cover 64 in the open position once the cover is fully opened. If desired, cut 62 may be made by straight cuts of partial depth on the top and bottom surfaces.

Carton blank 10 is formed from paperboard or other suitable materials. The carton may be given barrier properties by using a carton blank made of a barrier board such as "Super MVTR Board" available from Jefferson Smurfit/Container Corp. of America or by adhering a barrier layer to the carton blank as by inside- or outside-film lamination. The barrier layer may be a plastic such as polyethylene, or preferably polypropylene.

The carton is erected by adhering the outside of glue flap 19 to the inside of second side panel 22 to form a flattened tube. It may be desirable to stack the flattened tubes prior to erection of carton blanks. Since the cover and plug are taken from within the flaps of the carton, they do not add any additional thickness to the carton and do not cause any imbalance when the flattened tubes are stacked.

The flattened tubes are then squared and the upper and lower closure flaps are closed and adhered to each other to close the carton. After either the upper or lower closure flaps have been closed, product is inserted from the opposite end prior to closure of the remaining closure flaps. The lower closure flaps are closed by folding inwardly first and second minor flaps 40 an 44, then folding inside major flap 38 and applying adhering means and folding inwardly outside major flap 42. The adhering means such as cold or hot melt adhesive secures the outside and inside major flaps together.

The upper closure flaps are closed by folding inwardly minor flaps 30 and 34 and then folding inwardly inside major flap 28. Importantly, adhering means are applied to the top of plug 51 to permit it to adhere to cover 64 when outside major flap 32 is folded on top of inside major flap 28. Conveniently, the adhering means can be applied to areas 60, which may be debossments, on plug 51. Of course, inside major flap 28 will be adhered in other places to outside major flap 32 as well. If desired, a layer of clear plastic 74 may be applied on top of the cover to reinforce it.

Figure 2:
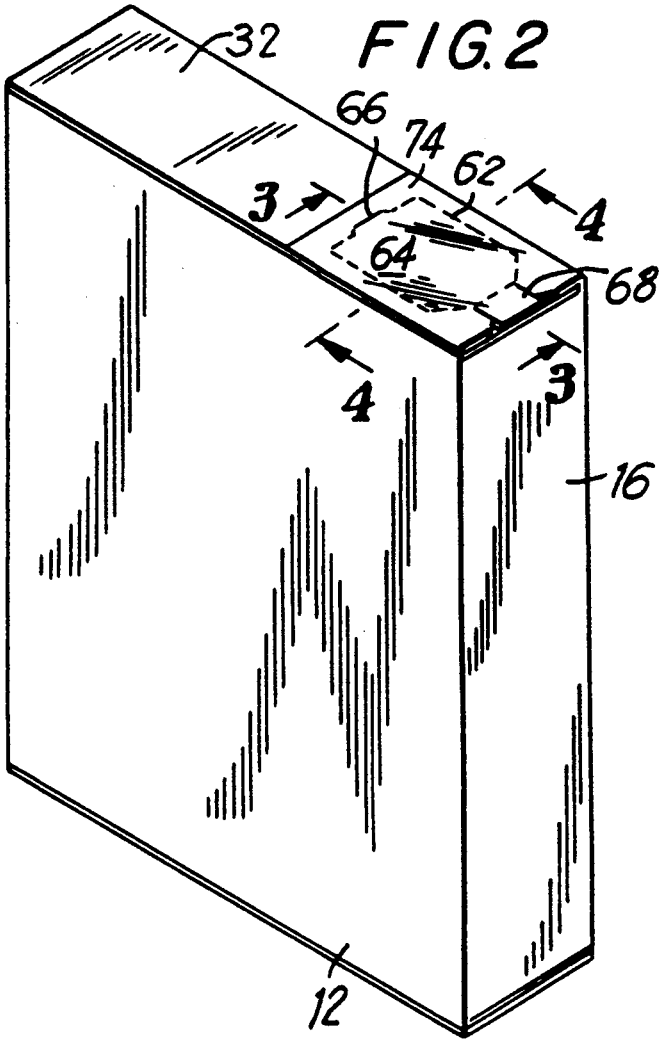
FIG. 2 is a perspective view of the carton of the invention.
Figure 3:
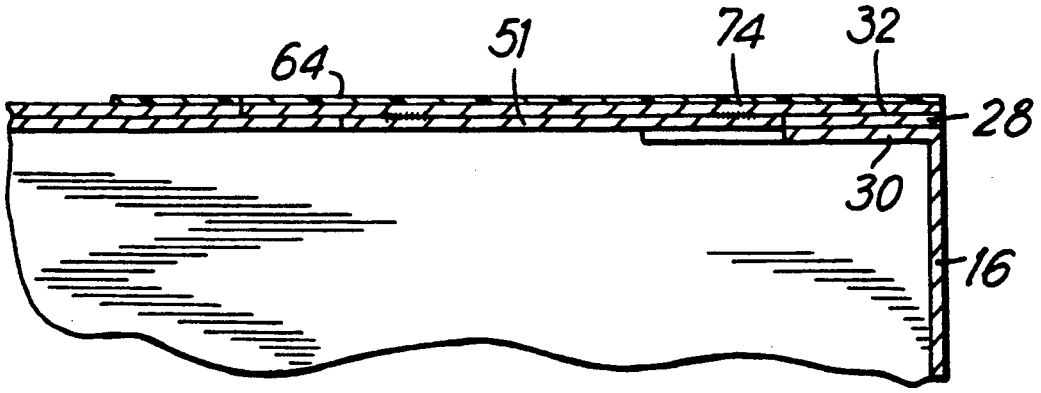
FIG. 3 is a cross section along the lines 3—3 of FIG. 2.
Figure 4:
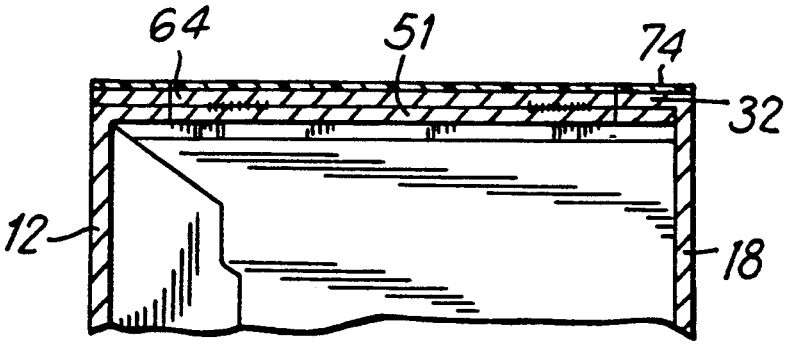
FIG. 4 is a cross section along the lines 4—4 of FIG. 2.

In operation, as best seen in FIG. 2, the consumer grasps pulling tab 68, which is preferably not adhered to underlying inside major panel 28, and pulls upwardly to open the carton. When the consumer pulls on pull tab 68, cover 64 is raised and it pivots along score line 66. As the cover is lifted, it detaches from the rest of outside major flap 32 as bridges between the two are broken. As the cover is lifted, it brings with it plug 51, which remains adhered to the underside of cover 64. Bridges between plug 51 and inside major flap 28 are likewise broken as the cover is opened.

Figure 5:
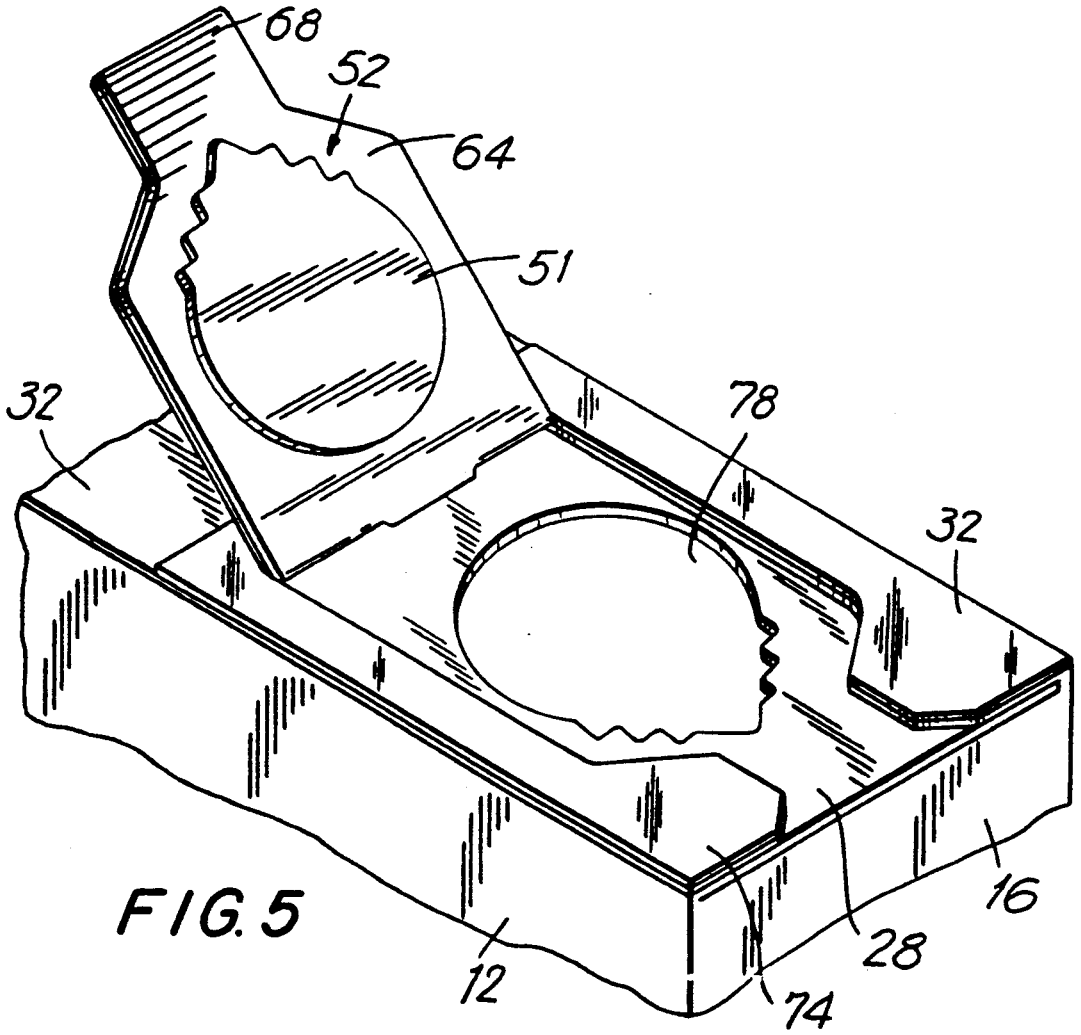
FIG. 5 is a perspective view of a portion of the carton of the invention when the cover is in the open position.

The cover opens and closes in a direction parallel to the longitudinal axis of the outside major flap, as seen in FIG. 5.

Foldable score line 66 provides a deadfold for the cover so that once pulled into the fully opened position as seen in FIG. 5, it remains in that position while product is poured from pouring opening 78 created in inside major flap 28 by lifting of cover 64.

When it is desired to reclose the carton, the cover is pushed forward into the closed position by the consumer. By applying pressure to the top of the cover over the plug, the plug becomes snugly fit within aperture 78, partly as a result of the sawtooth edges 52. Cover 64 remains closed until the consumer again opens the carton by grasping lift tab 68.

Figure 6:
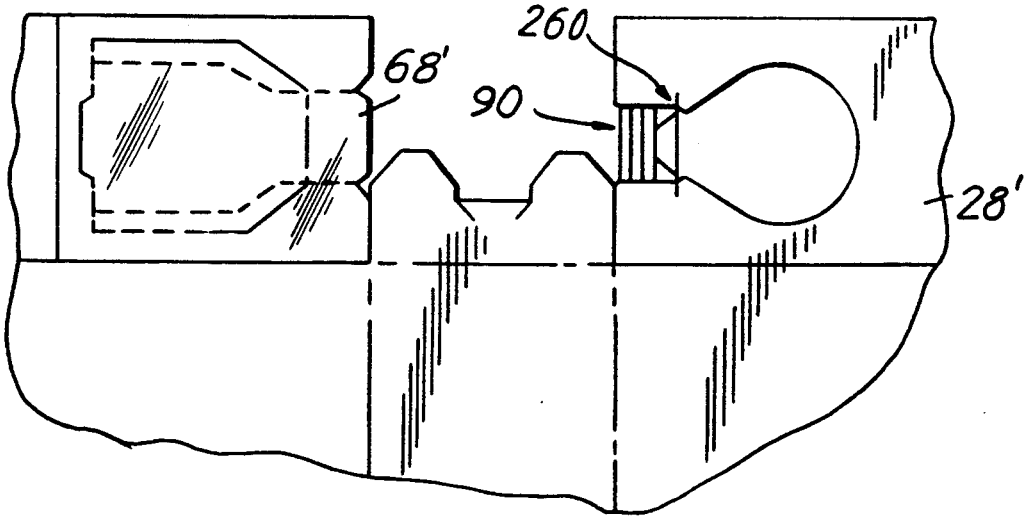
FIG. 6 is a top plan view of a portion of an alternate carton blank according to the invention.
Figure 7:
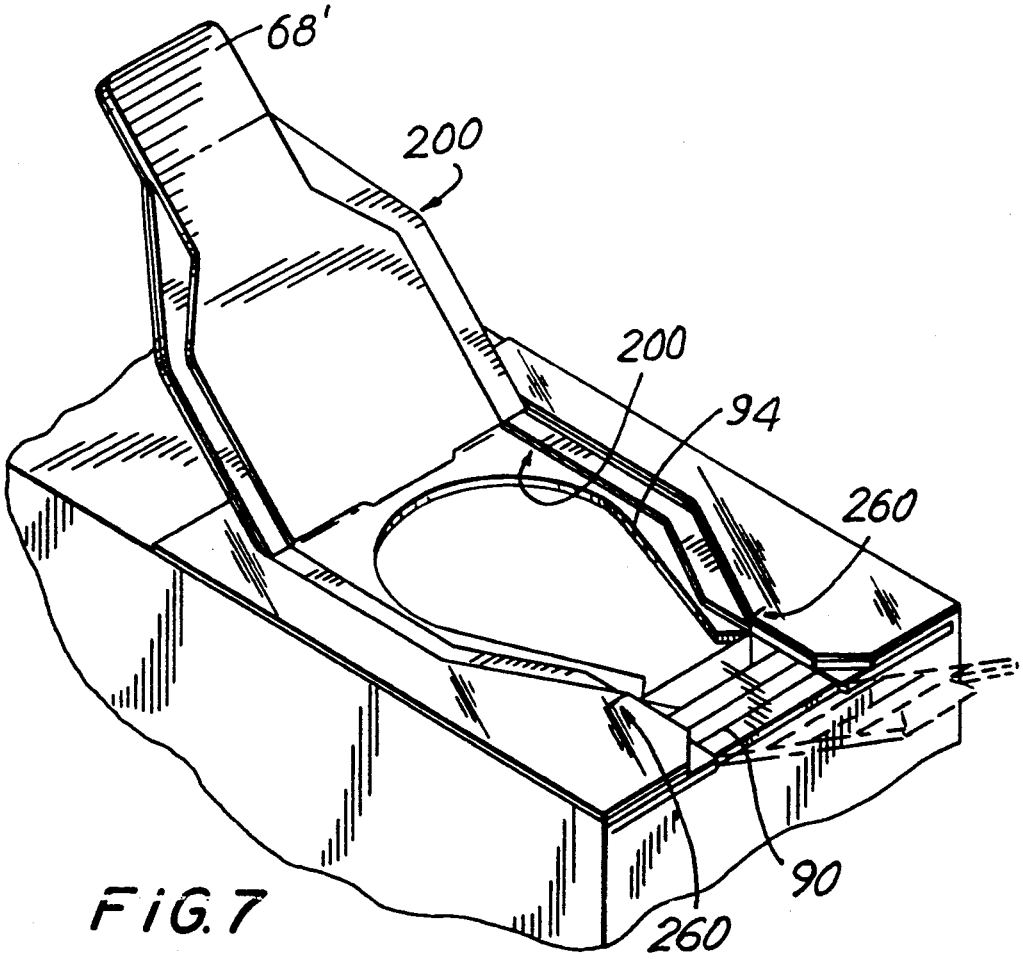
FIG. 7 is a top perspective view of the alternate carton with the cover in the open position.
Figure 8:
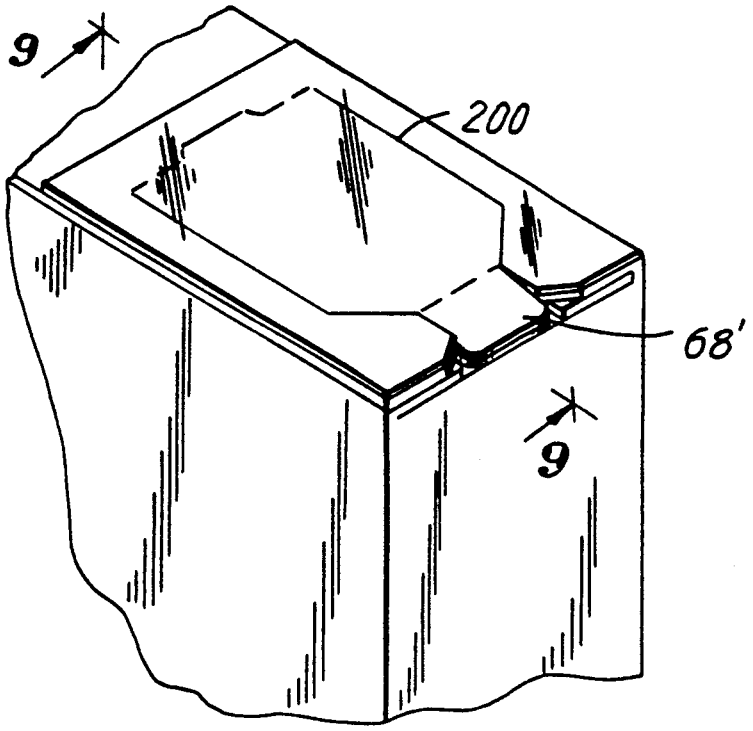
FIG. 8 is a top perspective view of the alternate carton of FIG. 7 having a cover in the closed position.
Figure 9:
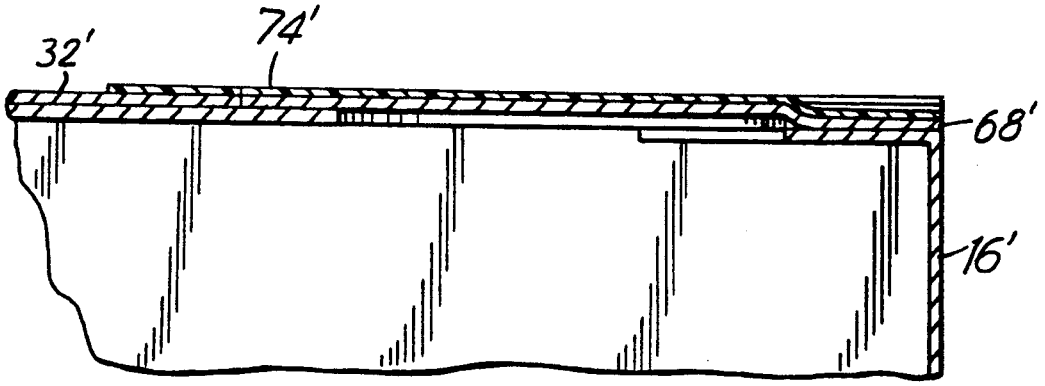
FIG. 9 is a cross section according to lines 9—9 of FIG. 8.

In an alternate embodiment of the invention (best seen in FIGS. 6 and 7), striations 90 are formed in inside major flap 28'. In this embodiment, adhesive means are applied to the inside major flap, but the striations ensure that grasping tab 68' is readily detachable from underlying inside major flap 28'. The embodiment of FIGS. 6 and 7 also features a keyhole-shaped aperture 94. FIGS. 6 and 7 also illustrate an embodiment in which there is no plug adhered to the cover.

The cut forming the cover may be a REV cut 200, as seen in FIG. 7. Cylinderboard usually is formed of eight, combined paper layers. A REV cut in cylinderboard is a 50% cut through the board on the top and a 50% cut through the board on the bottom surface. Laterally, both cuts are separated by approximately ¼". When the REV cut is torn open, the cylinderboard separates approximately in the middle of the board thickness. It is preferred that the cover by formed by a REV cut.

An additional feature of the invention illustrated by FIGS. 6 and 7 are the slits 260 into which tab 68' can be tucked to close the carton securely.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

What is claimed is:

1. A carton blank comprising an inside major closure flap, a first carton panel separated from said inside major closure flap by a score line, an outside major closure flap, a second carton panel separated from said outside major closure flap by a score line, a die cut in said inside major flap defining a removable plug therein, a die cut in said outside major flap defining a cover at least partially detachable from said outside major flap, said plug including debossments suitable for placement of hot melt during sealing of the carton.

2. The carton blank of claim 1, wherein said cover is connected to said outside major flap by a foldable score line.

3. The carton blank of claim 1 wherein the cover is connected to the outer major flap by breakable bridged connections.

4. The carton blank of claim 1 wherein said die cut defining the removable plug includes sawtooth edges.

5. The carton blank of claim 1 wherein said movable plug is connected to said inside major flap by breakable bridges.

6. The carton blank of claim 1 further comprising a minor flap between said outside and inside major flaps, said minor flap being dimensioned so as not to underlie said plug when said carton is erected and closed.

7. The carton blank of claim 6 wherein portions of said minor flap are cut away so as not to underlie said flap when the carton is erected and closed.

8. The carton blank of claim 1 wherein said first carton panel is the rear panel, said second carton panel is the front panel, said minor flap is separated by a score line from a first side panel and said carton blank further comprises a second side panel separated from said front panel by a score line, and bottom closure flaps.

9. The carton blank of claim 1 wherein said bottom closure flaps comprise a lower outside major flap separated from said front panel by a score line, a lower inside major flap separated from said rear panel by a score line, a first lower minor flap separated from the first side panel by a score line and a second lower minor flap separated from said second side panel by a score line.

10. The carton blank of claim 1 further comprising a glue flap separated from the rear panel by a score line.

11. The carton blank of claim 3 wherein the cover is made by straight cuts of partial depth on the top and bottom surfaces of said outer major flap.

12. A carton comprising outer walls including a front panel, a first side panel adjacent thereto narrower than said front panel and disposed perpendicularly to said front panel, a rear panel adjacent said first side panel and disposed parallel to said front panel and perpendicular to said first side panel, and a second side panel between said rear and front panels disposed parallel to said first side panel, an upper outside major flap closing said carton from below, one of said outer walls including a die cut defining a cover at least partially detachable from said outer wall, an inner wall disposed parallel to said cover-including outer wall inside said cover-including outer wall, said inner wall having a die cut defining a removable plug therein, said plug being adhered to said cover, the plug including debossments and means adhering the plug to the outer wall placed within said debossments.

13. The carton according to claim 12 wherein said cover is connected to said cover-including outer wall by a foldable score line.

14. The carton of claim 12 wherein the cover is connected to the cover-including outer wall by breakable bridged connections.

15. The carton of claim 12 wherein the die cut defining the removable plug includes sawtooth edges.

16. The carton of claim 12 wherein the plug is adhered to the cover-including outer wall with hot melt adhesive.

17. The carton of claim 12 wherein said upper outside major flap is separated by a score line from one of said front or rear panels, the upper inside major flap being separated by a score line from the other of said front or rear panels, a minor flap below said inside major flap at an end of said carton having the cover and separated from said side panel by a score line, said minor flap substantially not underlying said plug so that when said plug is removed and product is poured from said cartons, said minor flap does not impede the flow of product therefrom.

18. A carton comprising outer walls including a front panel, a first side panel adjacent thereto narrower than said front panel and disposed perpendicularly to said front panel, a rear panel adjacent said first side panel and disposed parallel to said front panel and perpendicular to said first side panel, and a second side panel between said rear and front panels disposed parallel to said first side panel, an upper outside major flap closing said carton at the top of said carton and a lower outside major flap closing said carton from below, one of said outer walls including a die cut defining a cover at least partially detachable from said outer wall, an inner wall disposed parallel to said cover-including outer wall inside said cover-including outer wall, said inner wall having a die cut defining a removable plug therein, said plug being adhered to said cover, the cover being formed by straight cuts of partial depth on the top and bottom surfaces of said outside major flap.

19. The carton of claim 18 wherein the removable plug is connected to said inside wall by breakable bridges.

20. The carton of claim 18 wherein said plug includes debossments for and means adhering the plug to the cover-including outer wall are placed within said debossments.

* * * * *